US005507544A

United States Patent [19]

McQuade et al.

[11] Patent Number: 5,507,544

[45] Date of Patent: Apr. 16, 1996

[54] JUG HANDLE HOLDER

[76] Inventors: Edmund J. McQuade, 30409 Hillside Ter.; Robert L. Ransford, 34495 Mutts Way, both of Gold Beach, Oreg. 97444

[21] Appl. No.: 370,200

[22] Filed: Jan. 9, 1995

[51] Int. Cl.[6] ..... B65D 71/00

[52] U.S. Cl. ..... 294/159; 220/759; 294/170

[58] Field of Search ..... 294/87.2, 137, 294/153, 158, 159, 162, 163, 170, 171, 165, 166; 16/114 R, 114 B; 206/162; 215/100 A, 396; 220/759, 768, 770; 383/6, 13, 15, 25; D9/434, 455

[56] References Cited

U.S. PATENT DOCUMENTS

| | | | |
|---|---|---|---|
| D. 216,062 | 11/1969 | Domingo | 383/13 X |
| D. 294,915 | 3/1988 | Alonzo | D9/434 |
| D. 340,863 | 11/1993 | Daigle | 294/159 X |
| 3,306,507 | 2/1967 | Wilson | D7/394 X |
| 3,923,191 | 12/1975 | Johnson | 220/760 |
| 4,112,541 | 9/1978 | Tetradis | 383/13 X |
| 5,181,757 | 1/1993 | Montoya | 294/159 |
| 5,447,259 | 9/1995 | Erickson | 294/159 X |

FOREIGN PATENT DOCUMENTS

| | | | |
|---|---|---|---|
| 356147 | 2/1990 | European Pat. Off. | 294/159 |
| 2271986 | 12/1975 | France | 294/159 |
| 2541099 | 8/1984 | France | 294/170 |
| 3819580 | 12/1989 | Germany | 294/159 |
| 8103008 | 10/1981 | WIPO | 383/13 |

*Primary Examiner*—Johnny D. Cherry
*Attorney, Agent, or Firm*—Jerry T. Kearns

[57] ABSTRACT

A jug handle holder especially adapted for releasably securing a pair of containers together for sale and transport as a two unit package includes an integrally molded plastic body provided with a handle forming aperture and a pair of spaced resilient clip portions dimensioned for engagement with handle portions of conventional containers such as those commonly employed for packaging and sale of milk, water, orange juice, and other products. Predetermined handle length in conjunction with angular orientation of the resilient clip portions facilitates installation and removal of the jug handle holder and allows securement of conventional jugs with a minimum of separation to conserve shelf space and stabilize relative jug and holder positions during transport. The jug handle holder includes enlarged thickness inner and outer peripheral walls joined by a reduced thickness web portion and a plurality of reinforcement struts to provide a high strength holder while consuming a minimum of plastic. The jug handle holder is sufficiently durable for reuse and its integrally molded plastic construction allows economical recycling at the end of its life cycle.

10 Claims, 4 Drawing Sheets

JUG HANDLE HOLDER

BACKGROUND OF THE INVENTION

1. Field of the Invention

Manufacturers presently employ one gallon volume plastic containers or jugs for packaging of a variety of beverage products such as milk, water, orange juice, etc. These conventional jugs include a loop-type handle extending from a medial body portion to a neck portion and forming a handle and grasping aperture to facilitate carrying of the jug.

With an increase in high volume, low mark-up warehouse type retail operations, an increased interest has developed in multi-unit large quantity packaging to enable a consumer to purchase a relatively large quantity of products in exchange for a lower unit price.

The present invention addresses this need and interest by providing a jug handle holder adapted for releasable engagement with the handles of such conventional jugs to facilitate convenient packaging, sale, and transport of products packaged within such jugs as two unit packages.

2. Description of the Prior Art

The prior art has heretofore contemplated the securement of neck containers in multi-unit packages. Conventional prior art container securement devices include straps or sheets provided with apertures for engagement with the neck regions of containers. In order to release such conventional containers from multi-unit packages, the securing devices must be torn or severed, thus destroying the potential for reuse. Additionally, typical prior art multi-unit container packaging must be applied by the manufacturer, and does not allow expeditious installation and removal of individual containers from multi-unit packages by retail store personnel and customers.

SUMMARY OF THE INVENTION

Accordingly, it is an object of the present invention to provide a new and improved jug handle holder which includes an integrally molded plastic body provided with a handle forming aperture and a pair of spaced resilient clip portions dimensioned for engagement with handle portions of conventional containers such as those commonly employed for packaging and sale of milk, water, orange juice, and other products. Predetermined handle length in conjunction with angular orientation of the resilient clip portions facilitates installation and removal of the jug handle holder and allows securement of conventional jugs with a minimum of separation to conserve shelf space and stabilize relative jug and holder positions during transport. The jug handle holder includes enlarged thickness inner and outer peripheral walls joined by a reduced thickness web portion and a plurality of reinforcement struts to provide a high strength holder while consuming a minimum of plastic. The jug handle holder is sufficiently durable for reuse and its integrally molded plastic construction allows economical recycling at the end of its life cycle.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
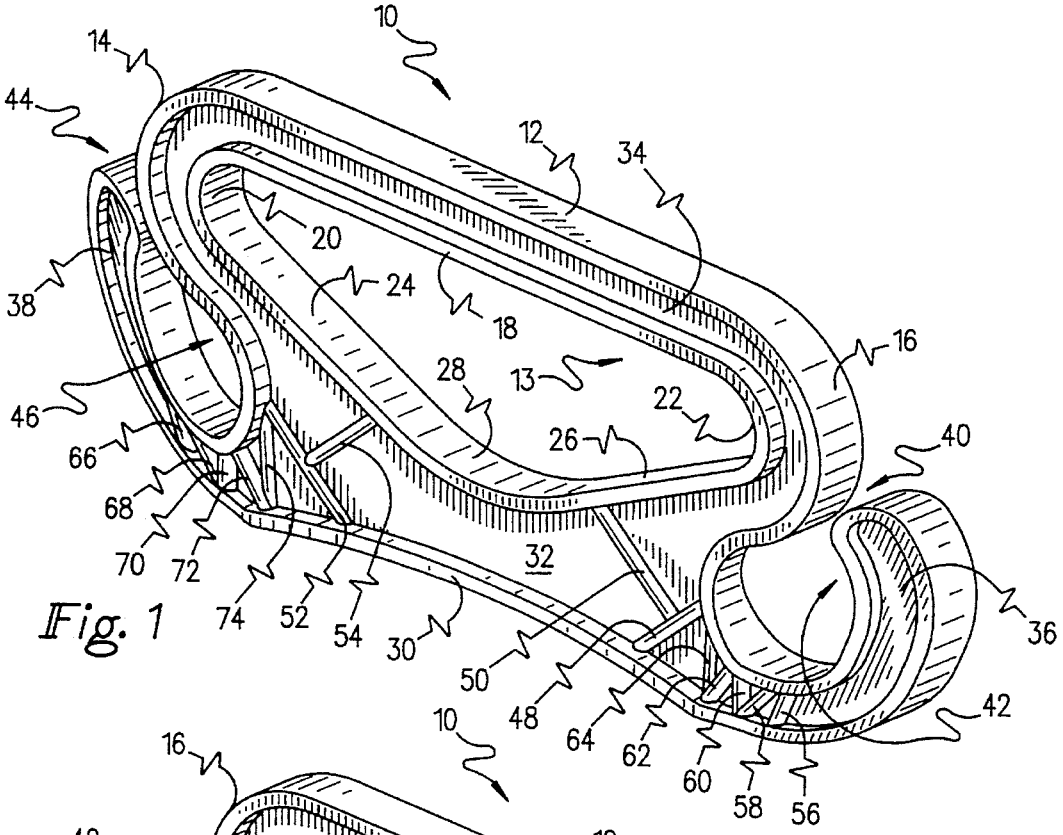
FIG. 1 is a front perspective view of a jug handle holder according to the present invention.

Referring now to the drawings, wherein like reference numerals designate corresponding structure throughout the views, and referring in particular to FIGS. 1 through 8, an improved jug handle holder 10 according to the present invention will now be described. The jug handle holder 10 comprises an integrally molded one piece member, preferably formed by an injection molding process from 10262 N Dow Polyethylene and Post Consumer Resin-50/50 Blend. Additionally, a variety of other plastic materials may also be employed.

The jug handle holder 10 includes an enlarged thickness outer peripheral wall having a top handle portion 12 terminating at opposite ends in respective radiused bend portions 14 and 16. An enlarged thickness inner peripheral wall includes a top straight handle bar portion 18 terminating at opposite ends in respective radiused bends 20 and 22. Inclined lower side wall portions 24 and 26 of the inner peripheral wall join in a radiused apex region 28 and terminate at respective opposite ends at radiused bend comer portions 20 and 22. The inner peripheral wall forms a closed curved configuration defining a substantially triangular hand grip opening 13 preferably dimensioned for insertion of the four fingers of an individual's hand therethrough.

Figure 6:
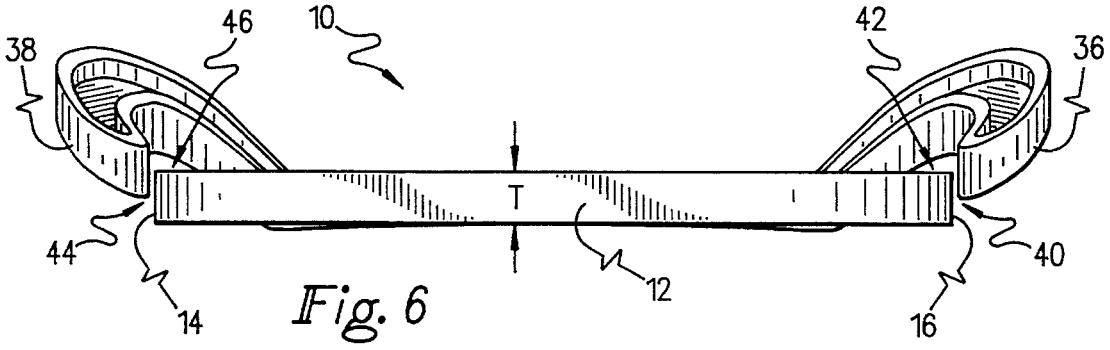
FIG. 6 is a top plan view illustrating the jug handle holder according to the present invention.

Lower 32 and upper 34 body or web portions having a reduced thickness, extend between and connect the closed curve outer and inner peripheral wall portions of the jug handle holder 10, and preferably comprise an integrally molded structure therewith. With reference to FIG. 6, the outer peripheral wall preferably possesses a thickness T of about 0.300" , while the web portions 32 and 34 preferably each possess a thickness of about 0.045". The web portions 32 and 34 preferably extend medially with respect to thicknesses of the interior and exterior peripheral wall portions, such that the enlarged thickness peripheral wall sections overhang the web portions by a substantially equal amount on each of the front and rear faces of the holder 10.

Figure 3:
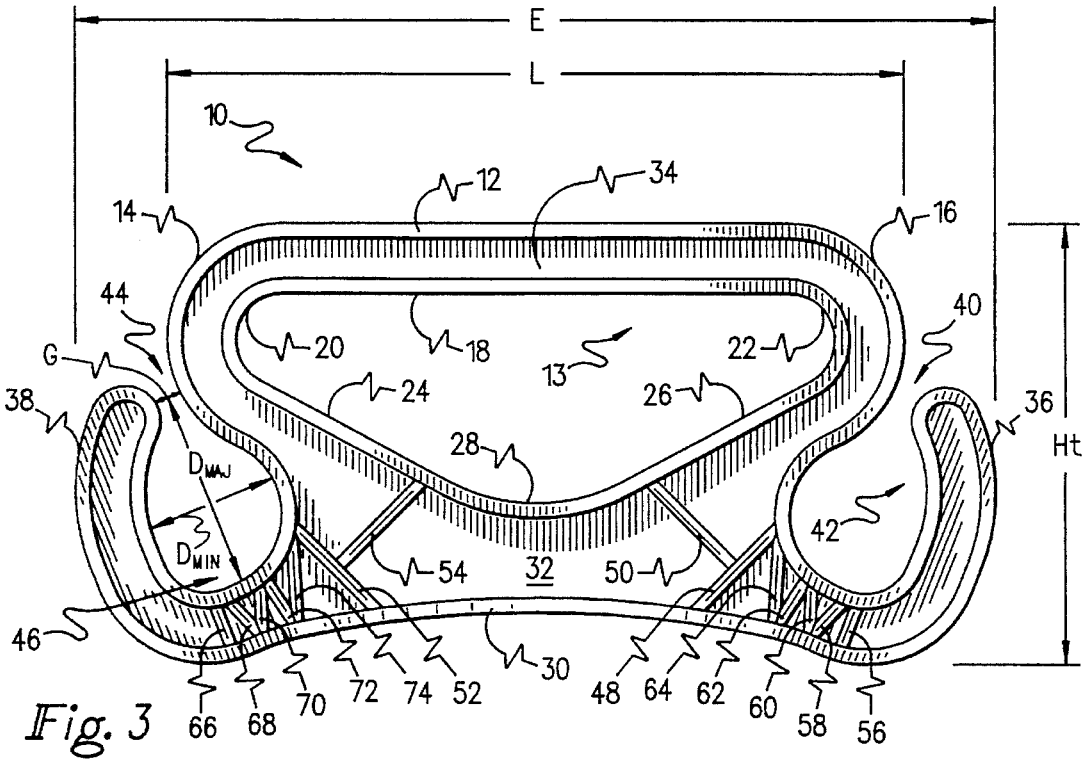
FIG. 3 is a front elevational view illustrating the jug handle holder according to the present invention.
Figure 8:
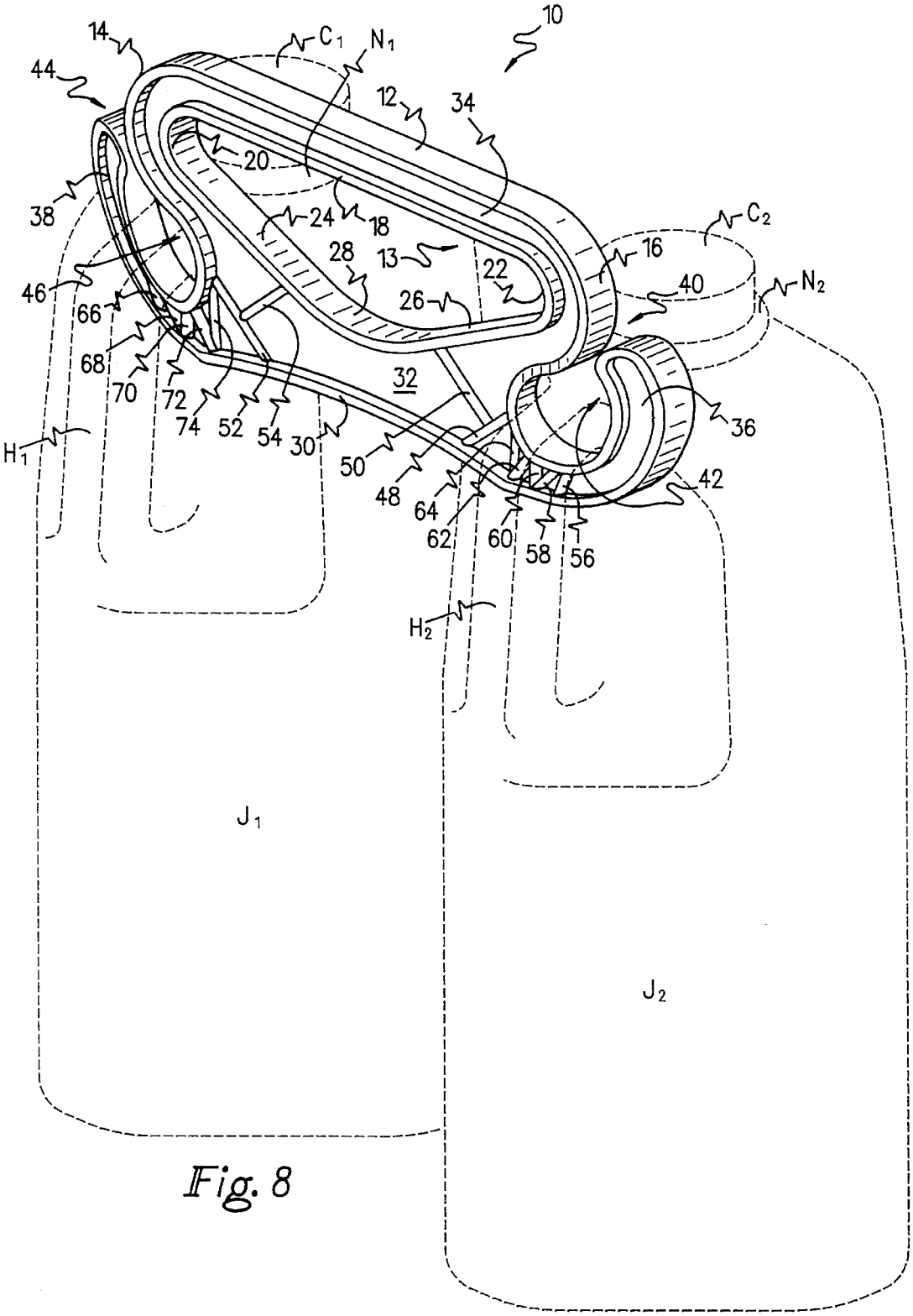
FIG. 8 is a perspective view illustrating a jug handle holder according to the present invention securing handles of two conventional jugs to form a two unit package.

The holder 10 preferably possesses a hand grip portion length L of about 4.090", an overall length E of about 4.910", and an overall height Ht of about 2.400", as illustrated in FIG. 3. These preferred dimensions allow securement of conventional one-gallon sized plastic jugs in side by side relation, with a minimum of separation, thus conserving shelf space. Additionally, these preferred dimensions provide for abutment of side wall portions of the jugs J1 and J2 during carrying by an individual, thus providing for maximum safety and stability, as shown in FIG. 8.

A pair of resilient ears or clip portions 36 and 38 extend symmetrically from opposite ends of the holder 10. As shown in FIG. 3, each of the clip portions 36 and 38 include a respective gap 40 and 44 communicating with respective jug handle receiving apertures 42 and 46. Inasmuch as the clip portions 36 and 38 are symmetrically constructed, the following description of the dimensions and characteristics of one applies equally to the other. With reference again to FIG. 3, a terminal free end portion of the ear or clip portion 38 terminates with a gap G, in an unflexed condition, relative to a lower exterior side wall portion of the radiused bend 14 of about 0.150". The jug handle receiving aperture 46 possesses an irregular rounded configuration with a maximum diameter Dmaj of about 0.840", and a minimum diameter Dmin of about 0.700".

Figure 4:
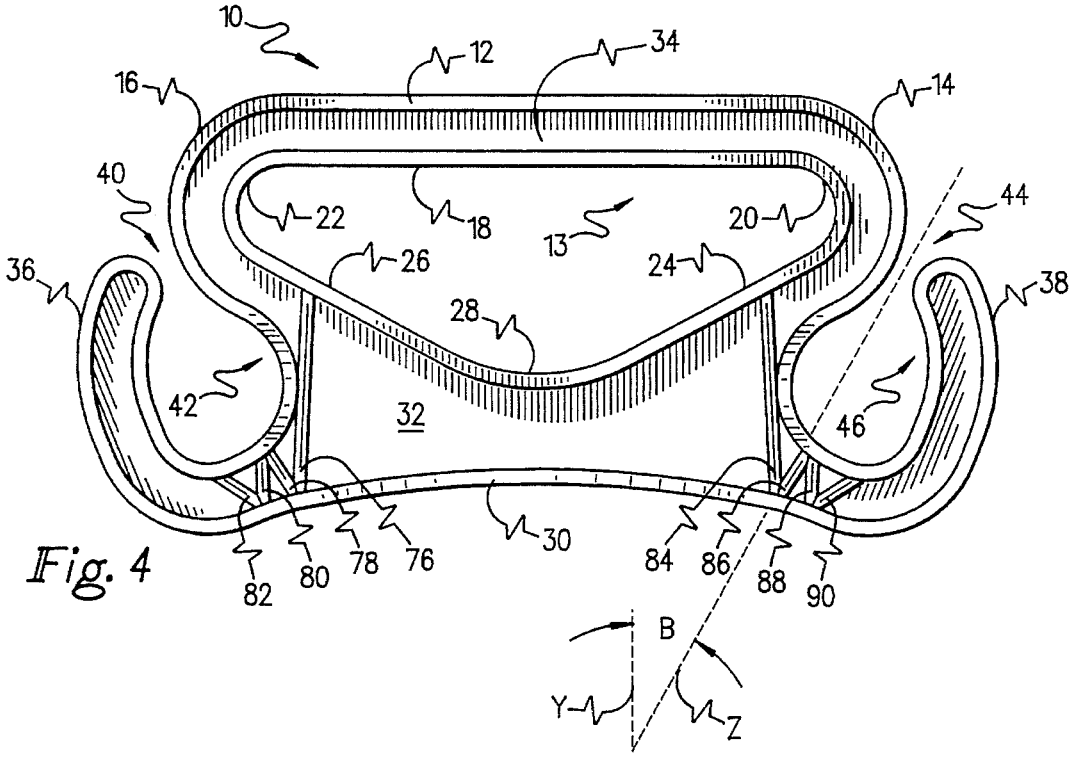
FIG. 4 is a rear elevational view illustrating the jug handle holder according to the present invention.
Figure 7:
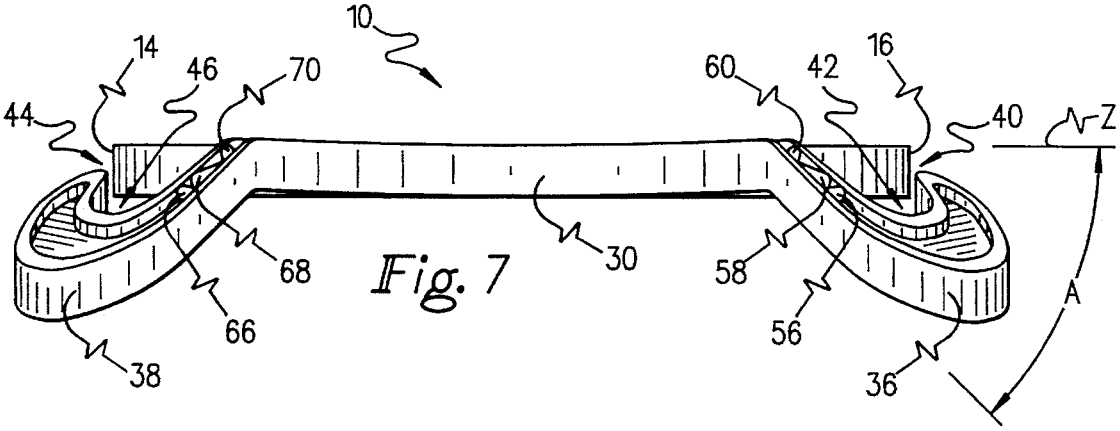
FIG. 7 is a bottom plan view illustrating the jug handle holder according to the present invention.

With reference to FIGS. 4 and 7, each of the clip portions 36 and 38 are inclined relative to the plane of the jug handle holder 10. For example, clip or ear 38 extends at an included angle A of 30 degrees with reference to a reference axis Z defined as located in the plane of the jug handle holder 10 (FIG. 4), passing generally through a reinforcement strut 86, and disposed at an angle B of 20 degrees relative to a vertical reference axis Y, also lying in a plane of the holder 10. Thus, with reference to the from elevational view illustrated in FIG. 3, each of the clips 36 and 38 is inclined or deformed rearwardly about respective reference axes corresponding generally with the major diameter (Dmaj) as can be appreciated with reference to FIGS. 1, 2, and 5–8. It should be noted that the illustration of reference axis Z in FIG. 7 is a diagrammatic projection for purposes of illustration, rather than a true indication of the position of reference axis Z.

Figure 5:
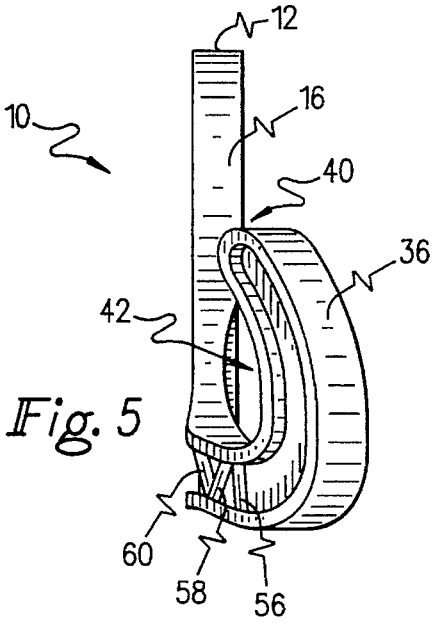
FIG. 5 is a right side elevational view illustrating the jug handle holder according to the present invention.

With reference to FIGS. 1, 3, 5, 7, and 8, the disposition of integrally molded reinforcement struts on the front face of the holder 10 will now be described in detail. Generally, each of the reinforcement struts described hereinafter comprise elongated members possessing a generally semi-cylindrical transverse cross-sectional shape extending outwardly from the surface of the web portion 32. A first strut 48 extends from an inner edge of a lower or bottom outer peripheral wall portion 30 and terminates at an opposite end in an intersection with an inner edge of the outer peripheral wall bounding the handle receiving aperture 42. The strut 48 thus forms a diagonal brace reinforcing ear or clip portion 36 and limiting flexure thereof. A strut 50 extends perpendicular to and substantially medially intersects strut 48 at one end, with an opposite end terminating in a juncture with the inclined side wall portion 26 of the interior peripheral wall bounding handle aperture 13. A plurality of sequentially intersecting struts 56, 58, 60, 62, and 64 extend in a zig-zag manner between spaced portions of the closed curve outer peripheral wall at the connecting or bite portion of the resilient ear or clip 36. With reference to FIGS. 5 and 7, it should be noted that the three outer struts 56, 58, and 60 are disposed in the angularly inclined plane of the clip portion 36, while the inner struts 62, 64, 48, and 50 lie substantially in the common plane of the holder 10.

The opposite ear or clip portion 38 includes a plurality of similarly inclined and oriented reinforcement struts 54, 52, 74, 72, 70, 68, and 66, the construction of which will be readily understood by those of ordinary skill in the art with reference to the above description of the symmetrical struts associated with the ear or clip portion 36.

Figure 2:
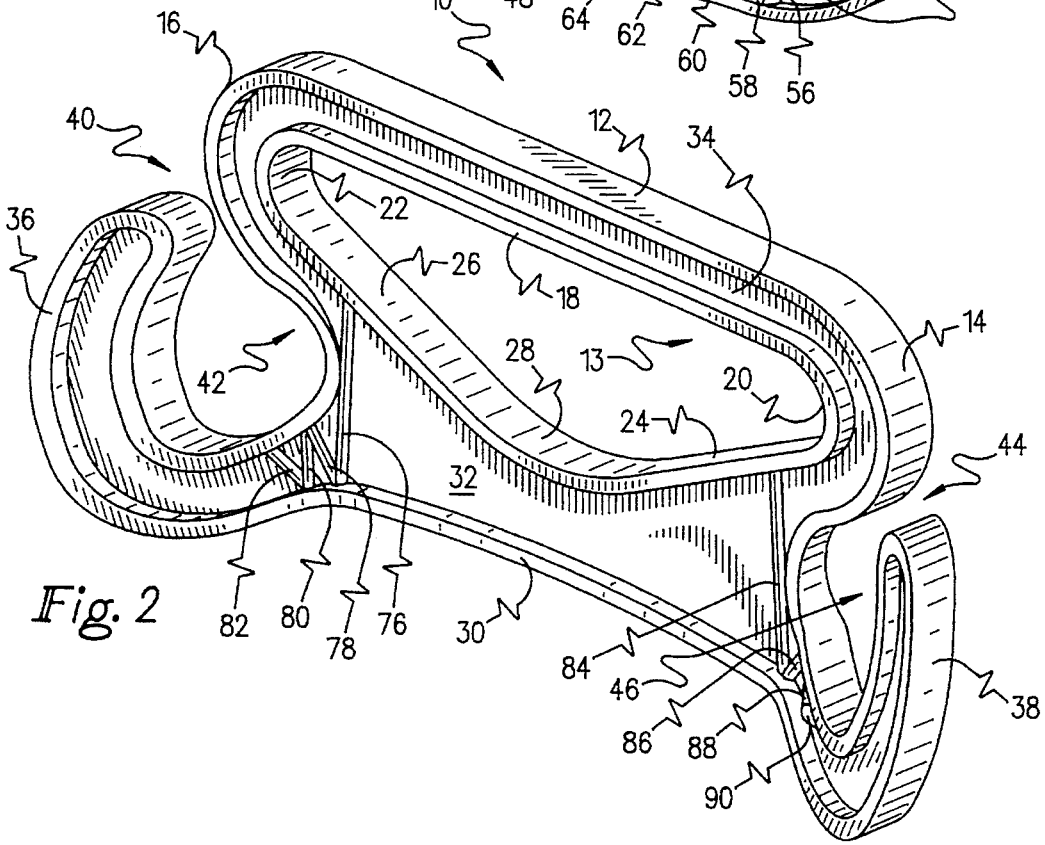
FIG. 2 is a rear perspective view of a jug handle holder according to the present invention.

With reference to FIGS. 2 and 4, a plurality of additional reinforcement struts disposed on the back face of the holder 10 also each generally comprise an elongated member having a semi-cylindrical transverse cross-sectional shape extending outwardly from the lower web portion 32 of the holder 10. The multiple strut arrangement associated with the clip portion 36 mirrors the multiple strut arrangement associated with the ear or clip portion 38, thus facilitating a complete understanding of one with reference to that of the other. With respect to clip 36, a longest strut 76 extends at a small acute angle relative to the vertical from an intersection with the inner peripheral wall adjacent the inclined portion 26 at one end, to an intersection with the bottom portion 30 of the outer peripheral wall at the other end. A plurality of substantially shorter linear struts 78, 80, and 82 extend in sequential zig-zag fashion from the bottom end of the strut 76, with each of the struts 78, 80, and 82 spanning the web portion 32 between the bottom outer peripheral wall portion 30 and the outer peripheral wall portion bounding the jug handle receiving aperture 42. Struts 76 and 78 lie substantially in the plane of the holder 10, while struts 80 and 82 lie in the inclined plane of the clip portion 36. As noted above, the opposite ear or clip portion 38 includes a plurality of symmetrically formed struts 84, 86, 88, and 90.

The particular orientation of the struts on both the front and rear faces of the holder 10 perform the important function of strengthening the bite or connecting portions of the clips 36 and 38, while limiting and controlling the degree of flexure thereof to an extent sufficient to facilitate engagement of the holder 10 with the handle portions H1 and H2 of conventional jugs J1 and J2, as shown in FIG. 8.

Additionally, the above described strut construction, in conjunction with the channel configuration formed by the reduced thickness web portions 32 and 34 and the enlarged thickness inner and outer peripheral walls, provides a holder 10 of sufficient strength and durability to allow repeated reuse while minimizing the amount of plastic material required for its initial construction. Due to the homogenous integral molding of the holder 10 from a plastic material, recycling at the end of its life cycle may be accomplished using conventional techniques.

The use of the holder 10 according to the present invention allows the food industry to offer more competitive pricing on multi-unit sales. For example, grocery retailers may connect two one-gallon milk jugs using the holder 10, and sell the resulting twin-pack at a reduced price compared to pricing of separate one-gallon jugs. The twin-pack may then be identified with a single part number or a three digit look-up code at a reduced price. In order to take advantage of this reduced pricing, the consumer must then buy two gallons at a time, thus directing twin-pack sales to relatively heavy users. Relatively light consumers will continue to purchase milk in one gallon or smaller sizes, without reducing the higher profit on smaller volume sales to the retailer.

The holders 10 may be initially installed by retail store shelf stocking personnel and subsequently removed by check out personnel upon sale. This allows the holders 10 to be maintained in the possession of the store and conveniently reused. Alternatively, consumers may be allowed to retain the holders 10 upon payment of an additional deposit.

In contrast with conventional multi-unit packaging devices, the present invention allows a single device to be utilized with a wide variety of different jug sizes. Further, the inventive holder 10 need not be installed initially by the manufacturer or packager, but may be readily installed by retail store personnel and also by consumers.

The aforementioned configuration and dimensional characteristics of the holder 10 provide many significant advantages. The reduced thickness channel construction of the web portions 32 and 34 allows for reduced raw material use, faster handle production cycle time, all without reducing necessary strength. The increased thickness inner and outer closed curve peripheral walls in conjunction with the reinforcing struts provide necessary rigidity and additional strength, particularly in the bite or connecting regions of the clips 36 and 38. The dimensions of the jug handle receiving apertures 42 and 46 fit a variety of different standard sizes of jug handles formed by various different manufacturers. The overall length and height of the handle and handle clip portions provide for a combination of installation ease and a safety factor when in use, while facilitating consumer removal of the handle. The handle length maintains joined jugs from separating when lifted and carried, and also ensures compatibility with a variety of different conventional jug sizes of different manufacture. The inclined orientation of the ears or clip portions 36 and 38 guarantees correct alignment during retail display and facilitates efficient handle installation. The maximum handle height prevents the installed handle from exceeding the overall height of the joined pair of jugs, thus avoiding retail display incompatibility. The dimensions of the handle holder 10 and grasping opening 13 accommodate a variety of retail customer hand strength and sizes, thus avoiding pain and discomfort.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A jug handle holder integrally molded from a plastic material, comprising:

a body portion including an enlarged thickness outer peripheral wall having a closed curve configuration and an inner peripheral wall also having a closed curve configuration;

reduced thickness upper and lower web portions extending between said outer and inner peripheral walls;

said inner peripheral wall defining a generally triangular hand grasping opening dimensioned for insertion of four fingers of a user's hand;

said upper body portion including an upper handle bar portion disposed above said hand grasping opening;

a pair of arcuate resilient clips disposed at opposite ends of said holder, each of said clips including a reduced width bight portion connecting said clip to said holder and a gap between a free end of said clip and said holder;

each of said arcuate clips defining an arcuate opening dimensioned for insertion of a loop type handle of a container therein through said gap upon flexure of said clip;

each of said clips inclined relative to said holder; and a plurality of reinforcement struts extending in zig-zag fashion on said lower web portion across said bight portion of each of said clips.

2. The jug handle holder of claim 1, wherein each of said arcuate openings defined by said clips include a major diameter extending through said bight portion connecting said clip to said body and through said gap.

3. The jug handle holder of claim 1, wherein said holder has an overall length of about 4.91 inches.

4. The jug handle holder of claim 1, wherein said holder has an overall height of about 2.4 inches.

5. A jug handle holder, comprising:

a substantially planar body portion including an enlarged thickness outer peripheral wall having a closed curve configuration and an inner peripheral wall also having a closed curve configuration;

reduced thickness upper and lower web portions extending between said outer and inner peripheral walls;

said inner peripheral wall defining a hand grasping opening dimensioned for insertion of at least a portion of a user's hand;

said upper body portion including an upper handle bar portion disposed above said hand grasping opening;

a pair of arcuate resilient clips disposed at opposite ends of said holder, each of said clips including a reduced width bight portion connecting said clip to said holder and a gap between a free end of said clip and said holder;

each of said arcuate clips defining an arcuate opening dimensioned for insertion of a loop type handle of a container therein through said gap upon flexure of said clip; and each of said clips inclined relative to said substantially planar body portion.

6. The jug handle holder of claims 5, further comprising a plurality of reinforcement struts extending in zig-zag fashion on said lower web portion across said bight portion of each of said clips.

7. The jug handle holder of claim 5, wherein said body portion comprises a plastic material.

8. The jug handle holder of claim 5, wherein said holder has an overall length of about 4.91 inches.

9. The jug handle holder of claim 5, wherein said holder has an overall height of about 2.4 inches.

10. The jug handle holder of claim 5, wherein each of said arcuate openings defined by said clips include a major diameter extending through said bight portion connecting said clip to said body and through said gap.

* * * * *